US012022956B2

(12) United States Patent
Rocco

(10) Patent No.: US 12,022,956 B2
(45) Date of Patent: Jul. 2, 2024

(54) MODULAR MATTRESS

(71) Applicant: Luigi Rocco, Naples (IT)

(72) Inventor: Luigi Rocco, Naples (IT)

( * ) Notice: Subject to any disclaimer, the term of this patent is extended or adjusted under 35 U.S.C. 154(b) by 360 days.

(21) Appl. No.: 17/233,757

(22) Filed: Apr. 19, 2021

(65) Prior Publication Data

US 2021/0321788 A1 Oct. 21, 2021

(30) Foreign Application Priority Data

Apr. 20, 2020 (IT) ..... 102020000008341

(51) Int. Cl.
*A47C 27/14* (2006.01)
*A47C 27/00* (2006.01)

(52) U.S. Cl.
CPC ..... *A47C 27/001* (2013.01)

(58) Field of Classification Search
CPC ... A47C 27/001; A47C 27/002; A47C 27/003; A47C 27/005; A47C 27/006; A47C 27/007; A47C 27/008; A47C 27/05; A47C 27/053; A47C 27/056; A47C 27/066; A47C 27/067; A47C 27/144; A47C 27/14
See application file for complete search history.

(56) References Cited

U.S. PATENT DOCUMENTS 132,686 A * 10/1872 Pack ..... A47C 27/001 5/722
540,112 A * 5/1895 Rude ..... A47C 27/001 5/722
787,450 A * 4/1905 Jacobs ..... A47C 27/001 5/722
2,547,840 A * 4/1951 Smith ..... A47C 27/001 5/722
3,467,972 A * 9/1969 Bastos ..... A47C 27/001 5/722

(Continued)

FOREIGN PATENT DOCUMENTS

CN 204105446 U 1/2015
FR 2730914 A3 8/1996

(Continued)

*Primary Examiner* — Justin C Mikowski
*Assistant Examiner* — Ifeolu A Adeboyejo
(74) *Attorney, Agent, or Firm* — INNOVATION CAPITAL LAW GROUP, LLP; Vic Lin

(57) ABSTRACT

A modular mattress comprising a plurality of modules configured to be positioned adjacent to each other forming a unique body having a support surface for a user, and comprising a plurality of engagement elements configured to reversibly engage a first and a second module of said plurality of modules, for avoiding movement from a correct relative position. The plurality of modules comprises a group of modules providing respective through holes aligned and oriented along a first predetermined direction, said aligned through holes being arranged to form a passageway passing through said modules of each group. There is one connection element configured to be positioned within said passageway, each connection element being provided at opposite ends, with respective engagement elements for reversibly engaging with respective engagement elements of a first and a second end module positioned, respectively, at opposite sides of each group of modules.

6 Claims, 13 Drawing Sheets

(56) References Cited

U.S. PATENT DOCUMENTS

| | | | | |
|---|---|---|---|---|
| 4,903,356 | A * | 2/1990 | Morisaki | A47C 27/001 5/951 |
| 5,842,746 | A * | 12/1998 | Rogers | A47C 31/10 297/219.1 |
| 9,131,782 | B1 * | 9/2015 | Baker | A47C 27/001 |
| 9,420,895 | B2 | 8/2016 | Lafleche et al. | |
| 2006/0169691 | A1 * | 8/2006 | Rothschild | A45C 11/20 220/7 |
| 2013/0269114 | A1 | 10/2013 | Wu | |
| 2015/0289670 | A1 * | 10/2015 | Mojtabavi | A47C 27/146 5/730 |
| 2018/0030725 | A1 * | 2/2018 | Macallen | A47G 5/00 |
| 2022/0395109 | A1 * | 12/2022 | Prince, Jr. | B33Y 80/00 |

FOREIGN PATENT DOCUMENTS

| | | | |
|---|---|---|---|
| WO | 2017206961 | A1 | 12/2017 |
| WO | 2018213203 | A1 | 11/2018 |

* cited by examiner

MODULAR MATTRESS

OBJECT OF THE INVENTION

This invention relates to the sector of articles used in the home, or in a hospital environment, and refers in particular to a mattress of a modular type, that is, made up of several modules assembled together.

BACKGROUND ART

As is well known, mattresses are large pillows normally used both in the home and in hospitals, usually placed on a support structure of a bed, such as a bed frame, but also simply placed on the floor of a room, in the case of the now widespread futons, for sleeping or resting. The mattresses used in hospitals, hotel rooms and other tourist facilities are inevitably used by various people.

The mattresses currently used, in particular because of their large size, which prevents them from being introduced into standard washing machines, cannot be easily washed or sanitised.

For this reason, especially in the case of mattresses used in hospitals, and therefore by sick people, they can be a true receptacle for viruses and bacteria which are thus transmitted from one person to another.

In an attempt to solve the above-mentioned drawbacks, modular type mattresses have been proposed, that is to say, comprising a certain number of modules which are assembled together to form a unique supporting body, but which can be disassembled, if necessary, in order to clean and sanitise them.

An example of a modular mattress is described in patent document U.S. Pat. No. 9,420,895. In this case, the modular mattress consists of a series of hollow elements with a substantially hexagonal cross-section. The different modular elements are held together by a containing body that prevents them from moving sideways.

Another type of modular mattress is described in patent document WO2018/213203. Also in this case, the modular mattress is formed by a plurality of elements which are placed together and held by a containing body so that they cannot shift during use of the mattress. The mattress structure may also comprise a surface covering layer and a lower layer, the latter designed to come into contact with a supporting structure of the bed, such as a bed base, or directly on the surface of the room where the mattress is to be placed.

However, the modular mattresses described above have the drawback of comprising a containing body. This necessarily has dimensions, in particular a length and width, which are large and equal to those of a common mattress. For this reason, the containing body cannot be washed and/or sanitised, for example by means of a washing machine of the type normally used in households or in hotels. Consequently, even the above-mentioned modular mattresses cannot guarantee the necessary hygienic conditions required for an object which is placed in close contact with the body of the users, and therefore collects not only dust, but also human flakes such as dandruff, remains of skin, hair, nails, with the possibility that they can encourage the proliferation of mites, or other insects, and therefore cause, as known, allergies and even serious respiratory problems. Similarly, the impossibility of being able to wash and sanitise them can lead to the proliferation, especially in hospitals, of viruses and bacteria which can then be transmitted from one individual to another. Other examples of mattresses with similar drawbacks are also described in patent documents WO2017/206961, FR2730914, CN204105446 and U.S. 2013/269114.

SUMMARY OF THE INVENTION

The aim of the invention to therefore to provide a modular mattress which is able to overcome the above-mentioned drawbacks of prior art mattresses, in particular, which allows a predetermined shape to be maintained when arranged in an assembled configuration, but which, at the same time, can be washed and sanitized in all its parts.

Another aim of the invention to provide a modular mattress which allows the washing and/or sanitising to be performed in an easy and economical manner by using equipment normally used also in a domestic or hotel environment, such as a washing machine.

A particular aim of the invention to provide a modular mattress which can be stored in a dedicated area occupying a reduced space when not in use, such, for example, in the case of a mattress used only occasionally for a guest.

These and other aims are achieved by a modular mattress comprising a plurality of modules configured to be positioned adjacent to each other so as to form a unique body having a support surface for a user, said modular mattress comprising a plurality of engagement elements configured to reversibly engage at least a first and a second module of said plurality of modules, in such a way as to prevent the same from being displaced from a correct relative position, the main feature of which is that the above-mentioned plurality of modules comprises at least one group of modules comprising a predetermined number of modules provided with respective through holes aligned and oriented along a predetermined direction, that said aligned through holes are designed to form a passageway through the modules of the, or each, group of modules, that there is, in addition, at least one connection element configured to be positioned in the, or in a respective, passageway and that the, or each, connection element, at opposite ends is provided with respective engagement elements configured to reversibly engage at respective engagement elements of a first and a second end module of the, or each, group of modules, and that the first and the second end module are arranged at opposite sides of the above-mentioned group of modules.

Other technical features of the invention are described in dependent claims defining particular embodiments of the invention.

In one possible embodiment the modules of the, or each, group of modules are distributed between a first side and a second side of the above-mentioned unique body.

Preferably, the above-mentioned first and second end modules are positioned, respectively, at the above-mentioned first side and the above-mentioned second side of the unique body.

Advantageously, said plurality of engagement elements comprises first engagement elements and second engagement elements integral with respective engagement surfaces of at least a first and a second adjacent module of said plurality, said first and said second engagement elements being designed to form a mutual engagement of a reversible fashion. For example, the first and second engagement elements of two adjacent modules may be, respectively, a first engagement part and a second engagement part of a Velcro element. Alternatively, the first and second engagement elements of two adjacent modules may comprise a magnet constrained to a first module and a ferromagnetic element constrained to the second module, said magnet and said ferromagnetic element being designed to form a mutual magnetic engagement.

More specifically, the engagement elements associated with said ends of said, or each, connection element may be configured to reversibly engage with respective engagement elements provided at the first and second end modules.

According to an embodiment of the invention, the above-mentioned engagement elements of said, or each, connection element may comprise a first engagement part of a Velcro element, and wherein said first and second end modules may comprise a second engagement part of the Velcro element, said first and said second engagement parts of said engagement elements being designed to achieve a mutual engagement of a eversible type.

Advantageously, at least one additional group of modules may be provided having respective additional through holes aligned and oriented along a predetermined second direction which forms a predetermined angle with the above-mentioned predetermined first direction. More specifically, the above-mentioned additional through holes are designed to form an additional passageway, and at least one additional connection element is provided designed to be arranged in the above-mentioned additional passageway. More specifically, the above-mentioned additional connection element is provided at opposite ends of respective additional engagement elements configured to reversibly engage with a first and a second additional end module. These can be positioned on the third and fourth sides, respectively, of the unique body.

More specifically, the additional engagement elements may comprise a first engagement part of a Velcro element, and wherein the first and second additional end modules are provided with a second engagement part of the Velcro element, the first and second engagement parts being designed to achieve a mutual engagement of a reversible type.

In particular, the engagement elements and the additional engagement elements may be of the same or different types.

Advantageously, the, or each, connection element and/or the, or each, additional connection element may be made of an elastic material.

In particular, the, or each, connection element may be designed for being positioned in the above-mentioned passageway, in an elongated configuration, in which it is elongated with respect to a rest length so that, when it is engaged at the ends opposite to the engagement elements of the first and second end modules, it is designed to exert an elastic force on the modules of the group connected by it between the first and second end modules.

Similarly, where there is at least one additional group of modules, the, or each, additional connection element is designed to be positioned in the above-mentioned additional passageway in an elongated configuration, in which it is elongated with respect to a rest length, so that when it is engaged at the opposite ends to the additional engagement elements of the first and second additional end modules it is designed to exert an elastic force on the modules of the additional group connected by it between the first and second additional end modules.

According to an embodiment of the invention, the above-mentioned modules of the above-mentioned plurality may be modules having all the same geometry but different size.

According to a possible variant, the above-mentioned modules may all have the same geometry and a same size.

For example, the above-mentioned modules of said plurality may have a prismatic shape with a polygonal cross-section.

In a further variation according to the invention, the adjacent modules of said plurality are provided with respective engagement surfaces designed to form a shape engagement. For example, the engagement surfaces may comprise at least a recessed portion at a module designed to engage in a protruding portion at the module adjacent to it.

Advantageously, each module of the above-mentioned plurality of modules can have dimensions of between 5×5×5 cm and 40×40×40 cm, so that they can be easily inserted into a standard washing machine through an entry door.

BRIEF DESCRIPTION OF THE DRAWINGS

The invention will now be illustrated by the following description of an embodiment thereof, made by way of a non-limiting example, with reference to the accompanying drawings in which.

DETAILED DESCRIPTION OF SOME EMBODIMENTS

Figure 1:
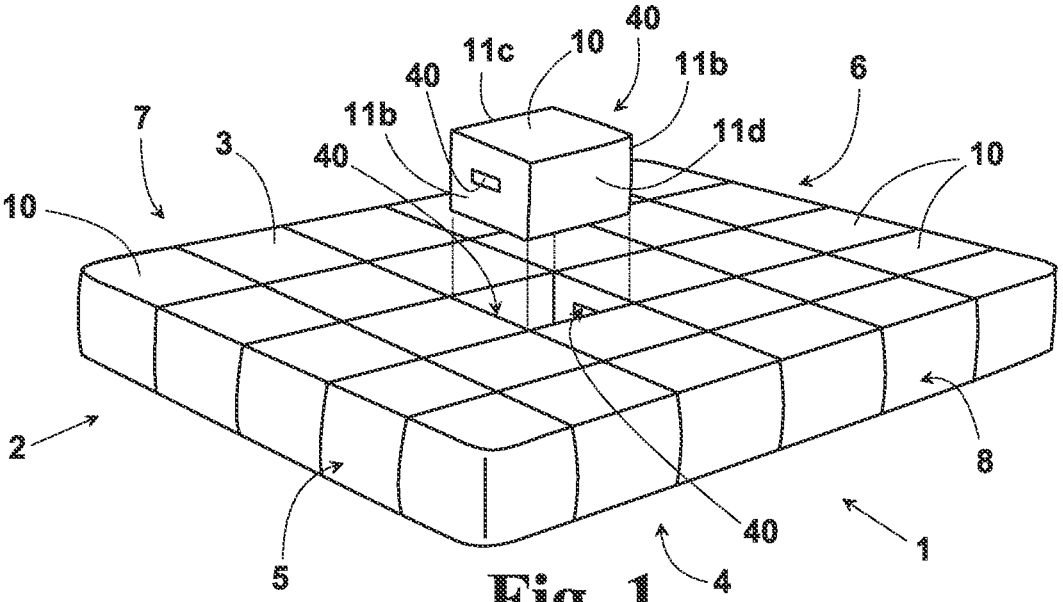
FIG. 1 schematically shows a side elevation perspective view of a first embodiment of a modular mattress according to the invention.

As shown schematically in FIG. 1, a modular mattress 1 according to the invention comprises a plurality of modules 10, for example 30 modules 10 arranged according to 5 columns and 6 rows, configured to be positioned adjacent to each other so as to form a unique body 2 having a support surface 3 for a user. More specifically, the unique body 2, on the side opposite the support surface 3, has a support surface 4 which, in use, will be, for example, rested on a support frame, such as a bed base, or alternatively directly on a support surface. According to the invention, the modular mattress 1 further comprises a plurality of engagement elements 40 configured to reversibly engage at least a first and a second module 10 of the above-mentioned plurality of modules 10, so as to prevent the same from moving from a correct relative position. In particular, the above-mentioned engagement elements 40 allow a unique body 2 to be obtained in which the various modules 10 are integral with each other. For example, the above-mentioned engagement elements 40 may be first and second engagement elements 40*a* and 40*b* of the Velcro type, or first and second engagement elements 40*a* and 40*b* of the magnetic type, or first and second engagement elements 40*a* and 40*b* of the snap type, for example the two halves of snap buttons.

Figure 2:
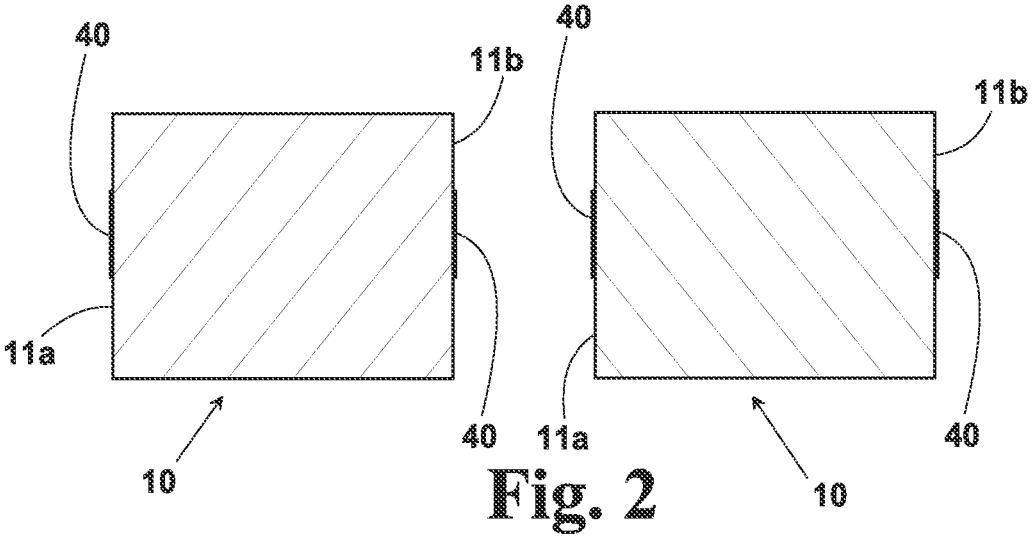
FIG. 2 schematically shows a longitudinal cross-sectional view of two modules of the modular mattress of FIG. 1 in a disengaged configuration.
Figure 3:
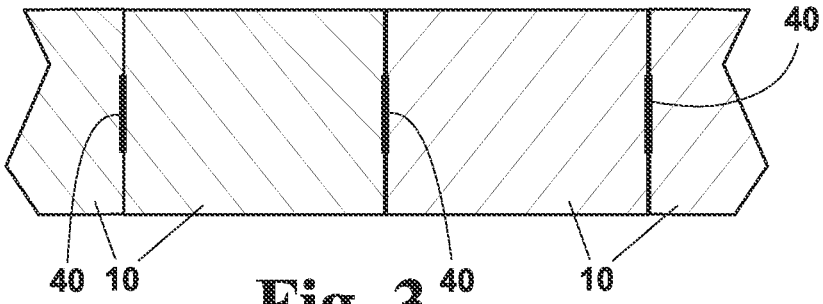
FIG. 3 schematically shows a longitudinal cross-sectional view of some modules of the modular mattress of FIG. 1 in an engaged configuration.

More specifically, as shown in FIGS. 2 and 3, the above-mentioned modules 10 may be provided with respective engagement elements 40 at respective engagement surfaces 11*a* and 11*b* designed to be arranged adjacent to each other and, therefore, allowing mutual engagement of a reversible type of the engagement elements 40 (see FIG. 3) when the modular mattress 1 is arranged in the assembled configuration of FIG. 1.

Preferably, all the modules 10 constituting the above-mentioned unique body 2 are provided with respective engagement elements 40 designed to engage each module 10 to at least one other module 10 adjacent to it. In particular, each module 10 may be provided at opposite sides 11*a* and 11*b* with the above-mentioned engagement elements designed to engage the module 10 to at least one module 10 adjacent thereto. In particular, in this way, each module 10 of a given row, or of a given column 10, may be constrained to at least one module 10 adjacent to it. According to an embodiment of the invention, each module 10 may be provided with the above-mentioned engagement elements 40 at least on two sides, so as to constrain a module 10 to at least a part of the modules 10 adjacent thereto.

According to some embodiments not shown for the sake of simplicity, each module 10 may be provided with the above-mentioned engagement elements 40 on all sides thereof, for example 4 sides 10*a*-10*d*, if it has a prismatic shape with a rectangular base, or a square base, as in the case illustrated by way of example in FIGS. 1 to 10, or three sides thereof, or a different number of sides depending on the shape of the modules 10.

More specifically, each module 10 may be provided with the above-mentioned engagement elements 40 at 2, 3, 4 or even more sides depending on its shape. In general, therefore, a module 10 may be provided with engagement elements 40 on all sides with which it is provided. The engagement elements 40 of each side, or engagement surface, of a module 10 will be designed to engage to respective engagement elements 40 of a module 10 adjacent thereto at the above-mentioned side, or the above-mentioned engagement surface.

According to an embodiment of the invention, schematically illustrated in FIGS. 4A to 9B, the above-mentioned plurality of modules 10 comprises at least a group 30, in FIG. 4, three groups 30, of modules 10 provided with respective through holes 15 aligned and oriented along a first predetermined direction 150. In particular, as shown in FIG. 4, the modules 10 of each group 30 may be arranged in one or more layers, along a same direction 150 longitudinal or transversal to the modular mattress 1. When there are two or more layers, as can be seen in FIGS. 4B, 4C and 4D, the modules can be aligned with each other vertically (FIGS. 4B and 4C) or offset (FIG. 4D).

Figure 6A:
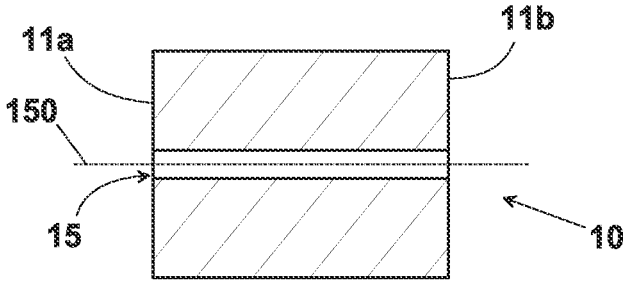
FIG. 6A schematically shows a transversal cross-sectional view of a module of the modular mattress of FIG. 4A to highlight some technical features.
Figure 6B:
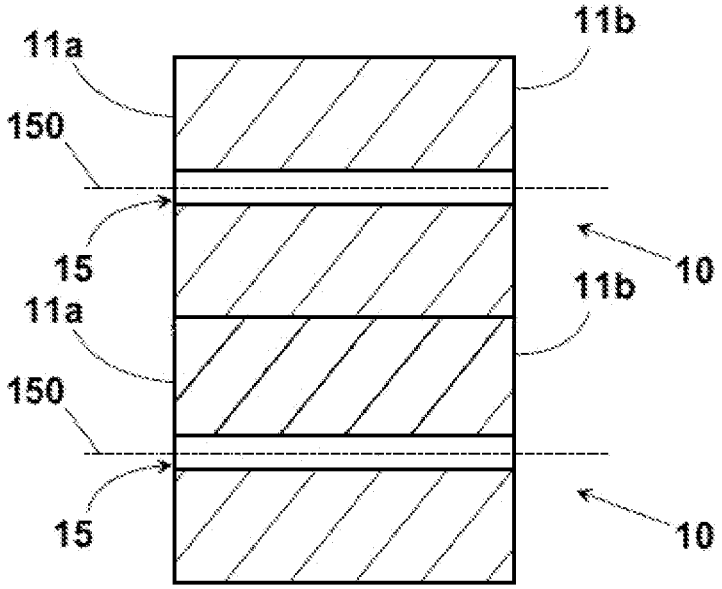
FIG. 6B shows a transversal cross-section of FIG. 4B.

More particularly, as shown in detail in FIG. 6, each through hole 15 may be designed to connect two opposite surfaces 11*a*, and 11*b* of the respective module 10. The through holes 15 of the same group 30 of modules 10 are arranged aligned so as to form a passageway 20 of at least a first and a second module 10 of the above-mentioned group 30. According to an embodiment of the invention, schematically illustrated in FIG. 6, the above-mentioned passageway 20 crosses the above-mentioned unique body 2 between a first side 5 and a second side 6. In this case, there is, in addition, at least one connection element 50 configured to be positioned in the above-mentioned passageway 20. In particular, the, or each, connection element 50 may be a cable, or a connecting rope, but also a tape, or another type of elongated connection element.

Figure 7:
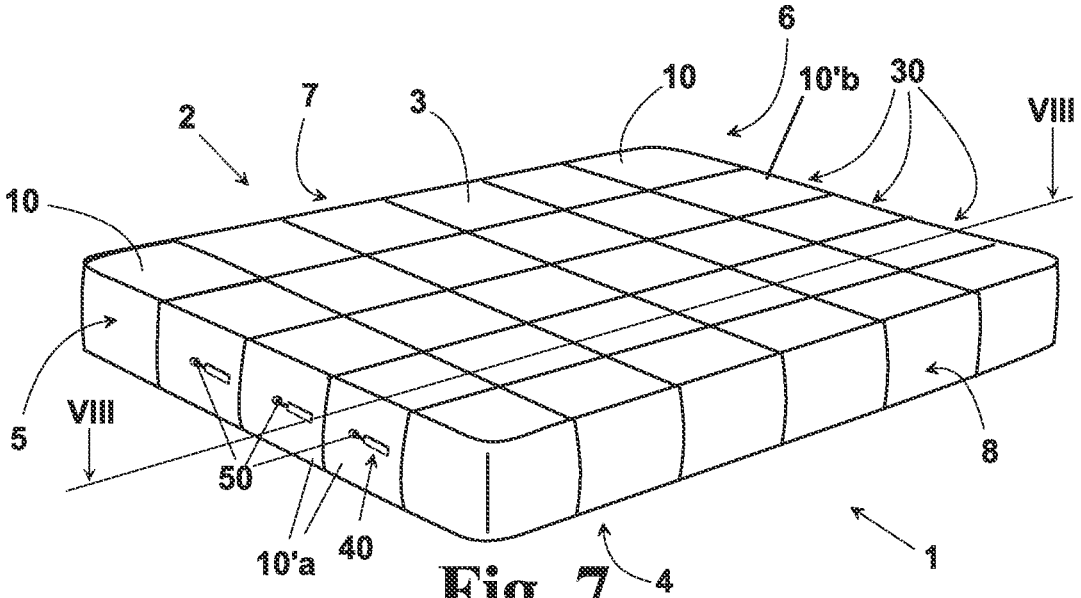
FIG. 7 schematically shows a perspective view of the lateral elevation of the modular mattress of FIG. 4A with the respective engagement elements.
Figure 8:
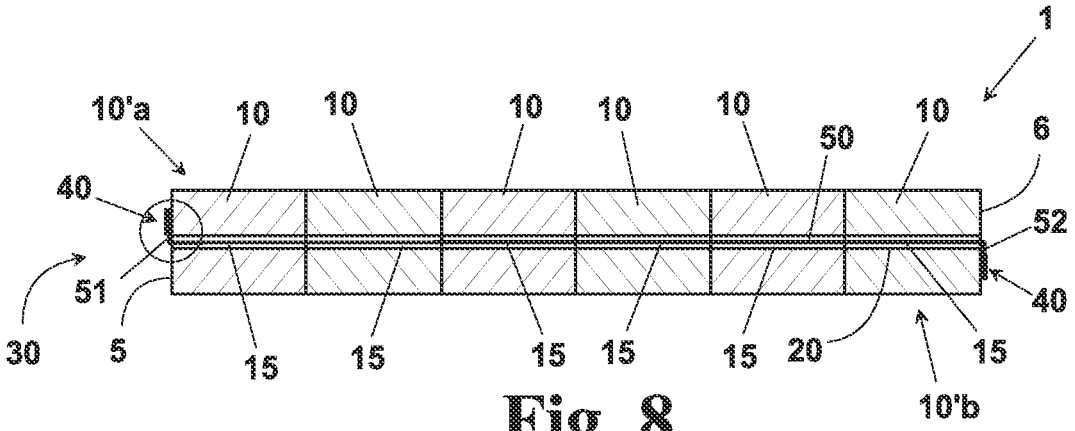
FIG. 8 schematically shows a cross-sectional view according to the arrows VIII-VIII of the modular mattress of FIG. 7.

As shown in FIGS. 7 to 9, the, or each, connection element 50, at opposite ends 51, and 52, is provided with respective engagement elements 40 configured to reversibly engage with respective end modules 10'*a* and 10'*b* positioned, advantageously, at opposite ends of the modules 10 forming the group 30.

Figure 9A:
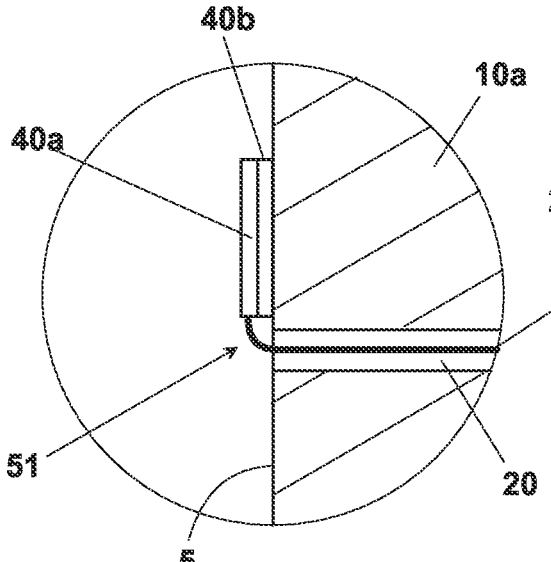
FIGS. 9A and 9B show an enlargement of a respective end module of the modular mattress of FIG. 8 to highlight some technical features.
Figure 9B:
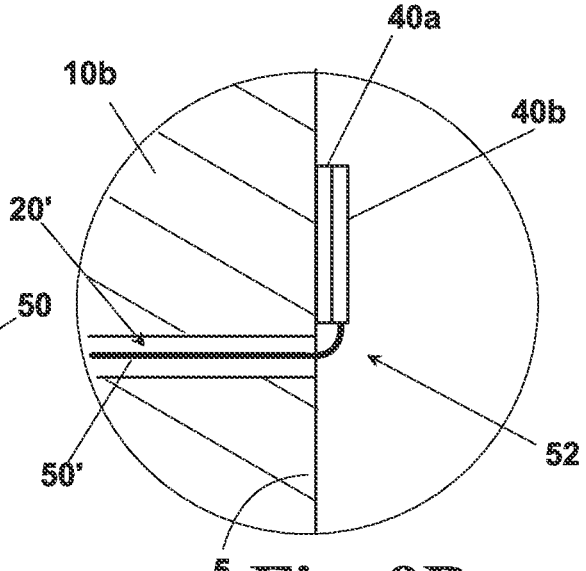

In the embodiment schematically illustrated in FIGS. 4A to 9B, the engagement elements 40 of each connection element 50 are designed to engage respective end modules 10'*a* and 10'*b* positioned, respectively, at the first side 5 and the second side 6 of the unique body 2. More in detail, as shown in detail in FIGS. 9A and 9B, the engagement elements 40 are configured to reversibly engage with respective engagement elements 40 provided at a first end module 10'*a* (FIG. 9A) and a second end module 10'*b* (FIG. 9B).

According to a possible embodiment, the above-mentioned engagement elements 40 comprise a first engagement part of a Velcro element, and the first and second end modules 10'*a* and 10'*b* are provided with a second engagement part 40 of the Velcro element, whereby, as is known, the first and second engagement parts of the engagement elements 40*a*, or 40*b*, and 40*b*, or 40*a* are designed to form a mutual engagement of a reversible type.

The "first engagement part" of a Velcro element is the part commonly referred to as "slotted" because it has slots, and the "second engagement part" of the Velcro element is the part commonly referred to as "hooked" because it has hooks. However, it is also possible that the first engagement part of a Velcro element may be the "hooked" part, and that the second engagement part of the Velcro element may be the "slotted" part.

In accordance with the invention and as described above with reference to FIGS. 1 to 3, the engagement elements 40 and the respective engagement elements 40 provided at the end modules 10'*a* and 10'*b* may be of a different type, for example snap buttons, or may be configured to form a mutual engagement of a magnetic type, for example comprising a magnet 40*a* and a ferromagnetic element 40*b* respectively. In general, the engagement elements 40 may be engagement elements of a reversible type, in any case capable of reversibly switching between an engagement configuration in which the, or each, engagement element 50 maintains the modules 10 of a same group 30 in an assembled configuration, and a disengagement configuration in which the, or each, engagement element 50 is disengaged from the modules 10 of above-mentioned group 30 which can, therefore, be easily disassembled to provide for their cleaning and/or disinfection, and, therefore, be able to temporarily store them in a warehouse, or in another place used for their storage.

Figure 4A:
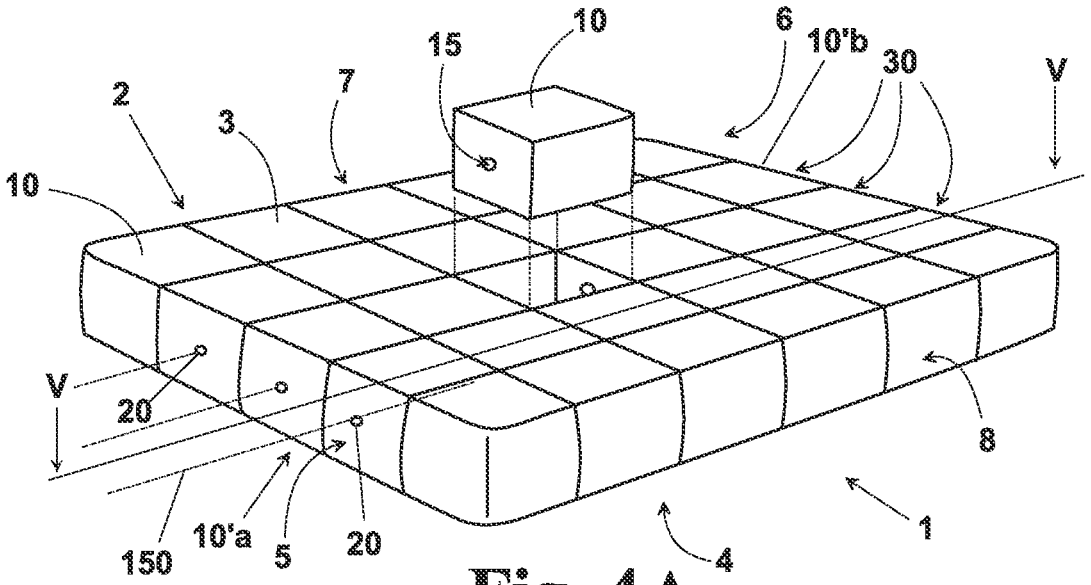
FIG. 4A schematically shows a side elevation perspective view of a first variant of the modular mattress of FIG. 1, without the engagement elements.
Figure 4B:
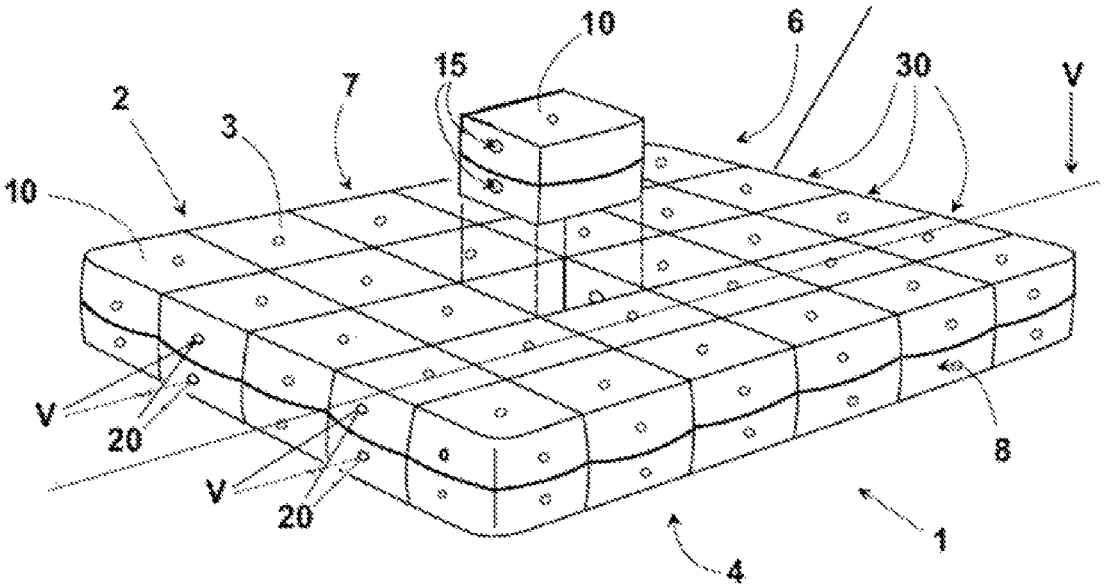
FIGS. 4B, 4C and 4D show modifications to the variant of FIG. 4A, in which there are several layers of modules, aligned or offset to each other and connected in both horizontal and transversal planes.
Figure 4C:
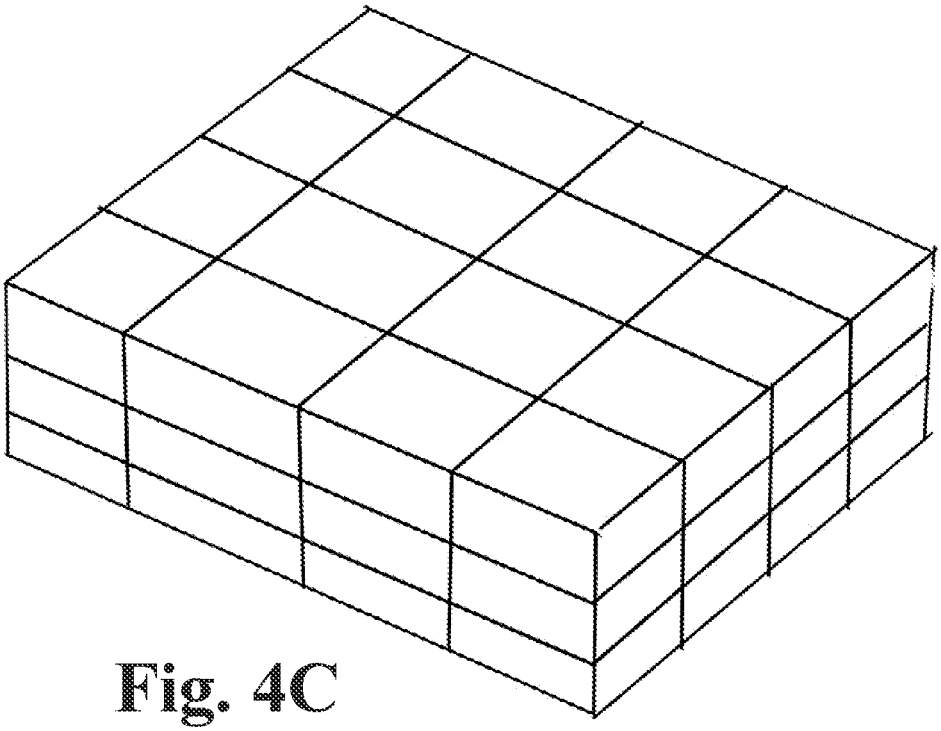
Figure 4D:
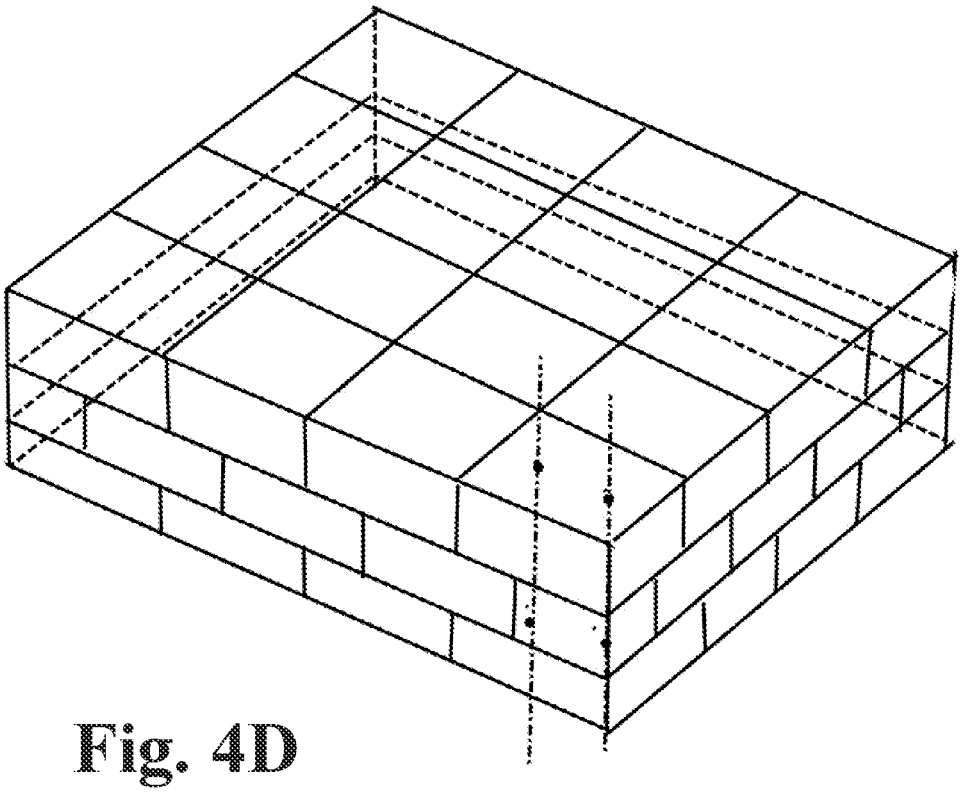
Figure 5A:
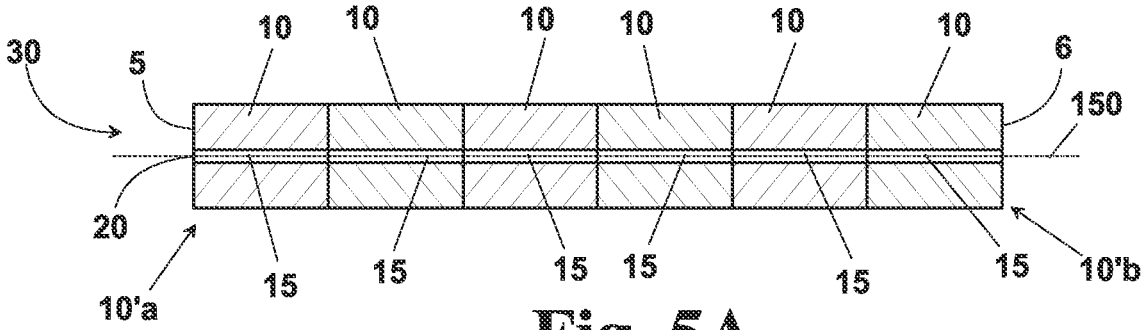
FIG. 5A schematically shows a cross-sectional view according to the arrows V-V of the modular mattress of FIG. 4.
Figure 5B:
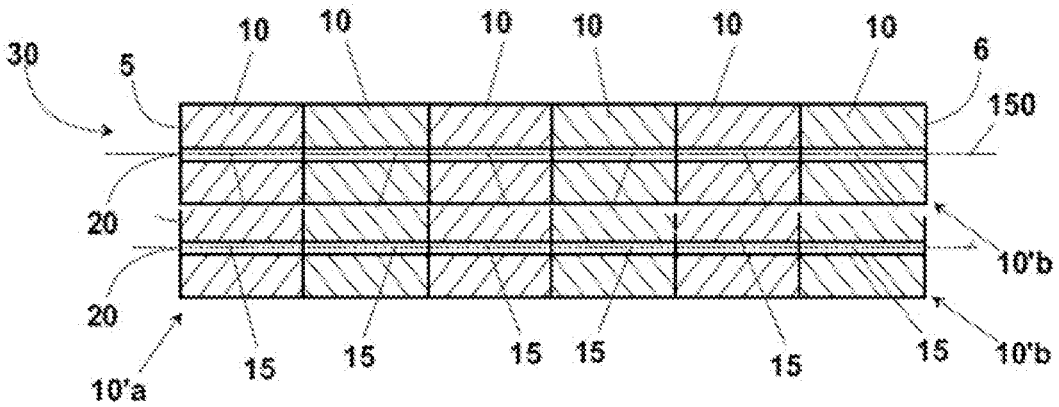
FIG. 5B shows a cross-section V-V of FIG. 4B.

As shown in FIGS. 1, 4A and 7, the modules 10 which make up the modular mattress 1 may all have the same shape, for example a prismatic shape with a rectangular or square cross-section, and the same dimensions.

Figure 10:
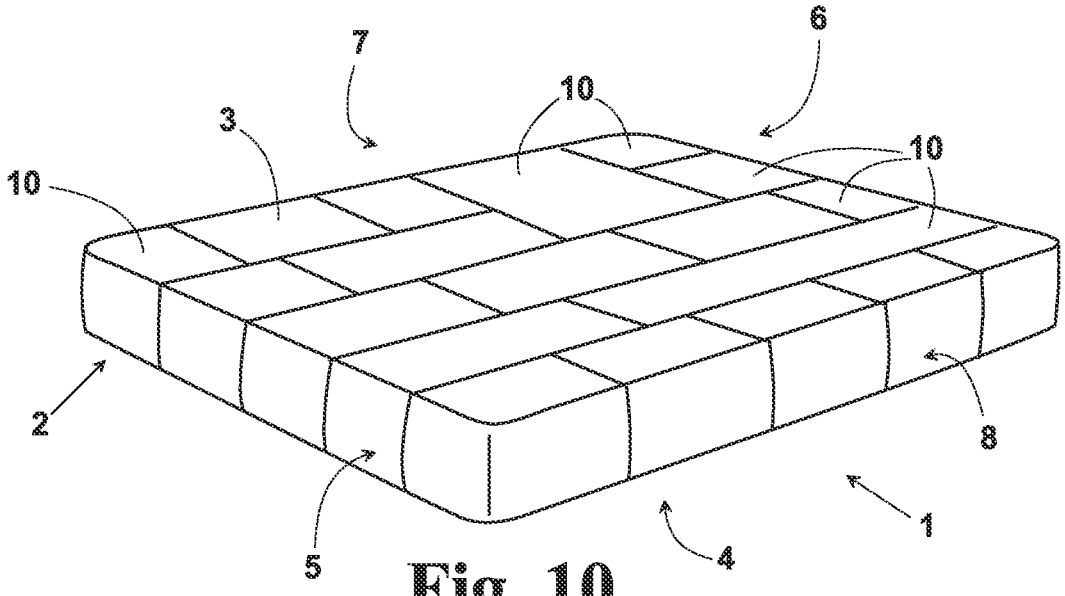
FIG. 10 schematically shows a side elevation perspective view of another variant of the modular mattress of FIG. 1.
Figure 11:
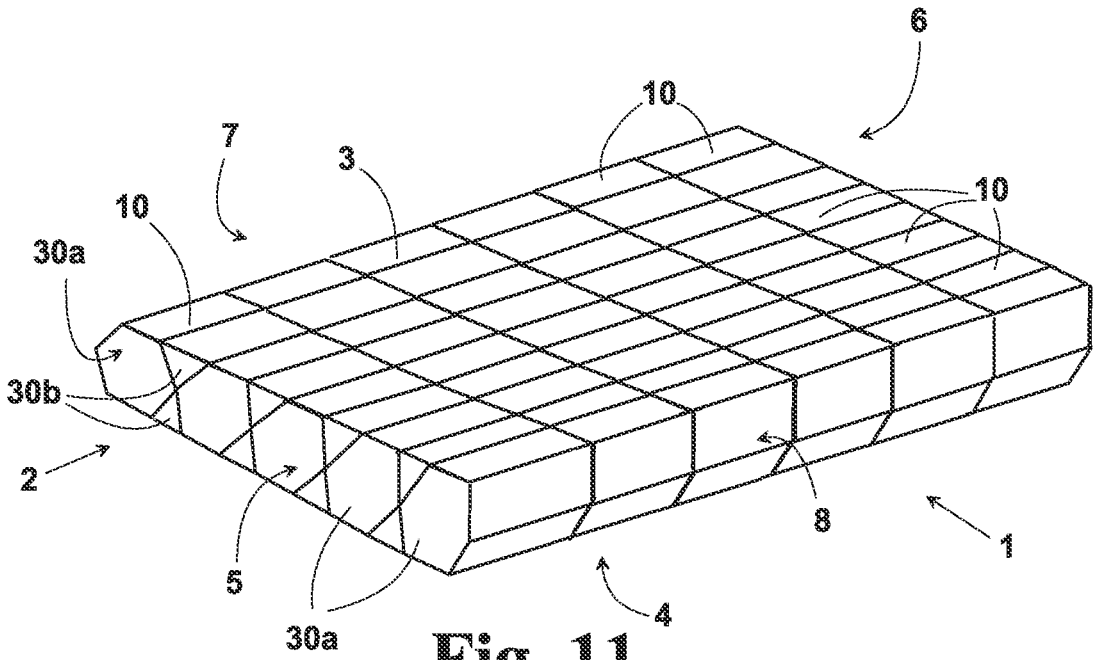
FIG. 11 schematically shows a side elevation perspective view of a further variant of the modular mattress of FIG. 1.
Figure 12:
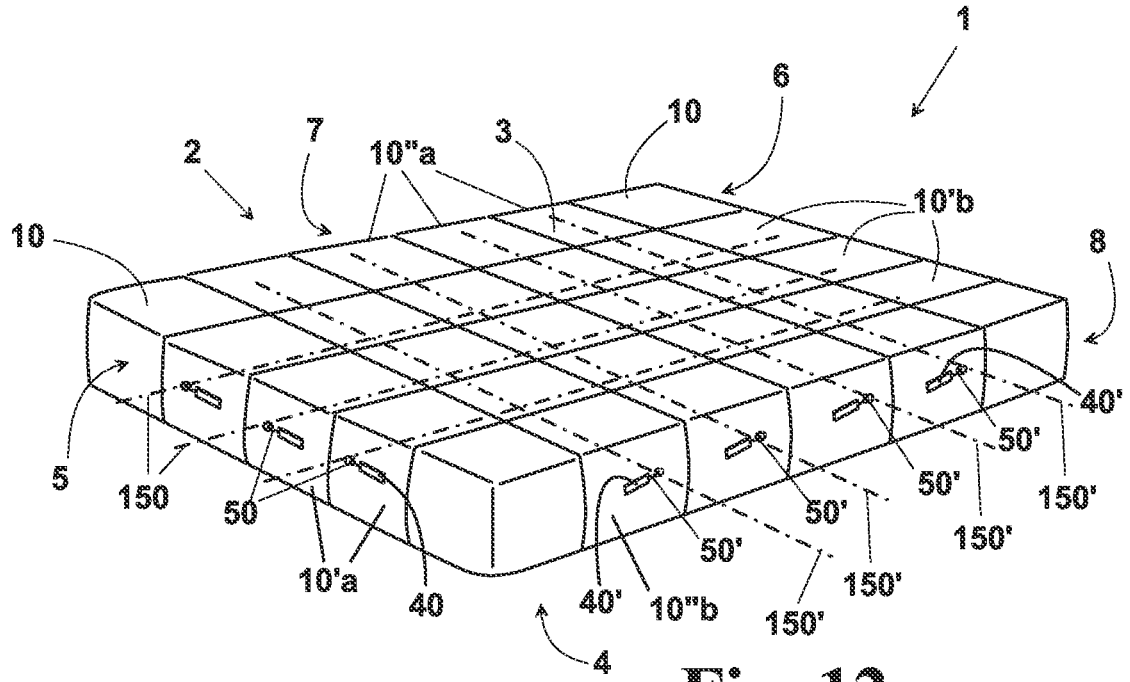
FIG. 12 schematically shows a side elevation perspective view of yet another variant of the modular mattress of FIG. 1.

As shown in FIGS. 10 and 11, however, it is also contemplated that the modules 10 of the modular mattress 1 may all have the same shape but dimensions that are not necessarily the same (see FIG. 10), or comprise at least two groups of modules 30*a* and 30*b* of different shapes, for example a first group of modules 30*a* having a prismatic shape with a hexagonal cross-section, and an additional group of modules 30*b* having a prismatic shape but a triangular cross-section and dimensions such that they can be arranged adjacent to each other to form the unique body 2 having the support surface 3. In particular, according to the embodiment shown in FIG. 11, due to the particular geometry of the two groups, the adjacent modules 10 are able to form a shape engagement which increases, therefore, the stability of the unique body 2 once all the modules 10 have been assembled together. It should be noted that the modules 10 of the embodiments schematically illustrated in FIGS. 10 and 11 can also be provided with the above-mentioned through holes 15 described above with reference to FIGS. 4 to 9B.

Figure 13:
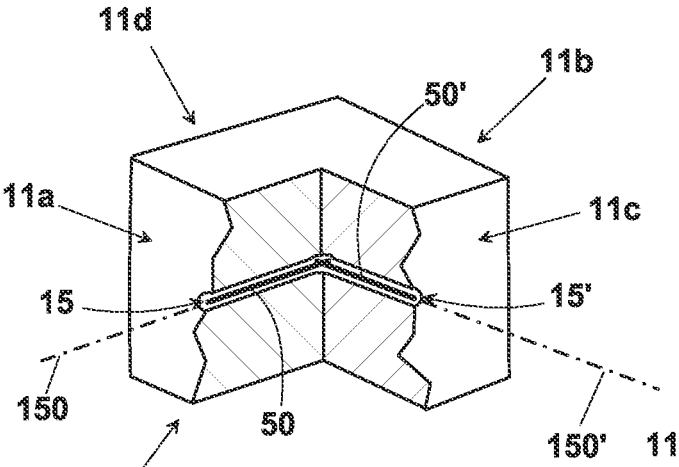
FIG. 13 schematically shows a sectioned view in two orthogonal planes of a possible embodiment of a module of the mattress of FIG. 12.
Figure 14A:
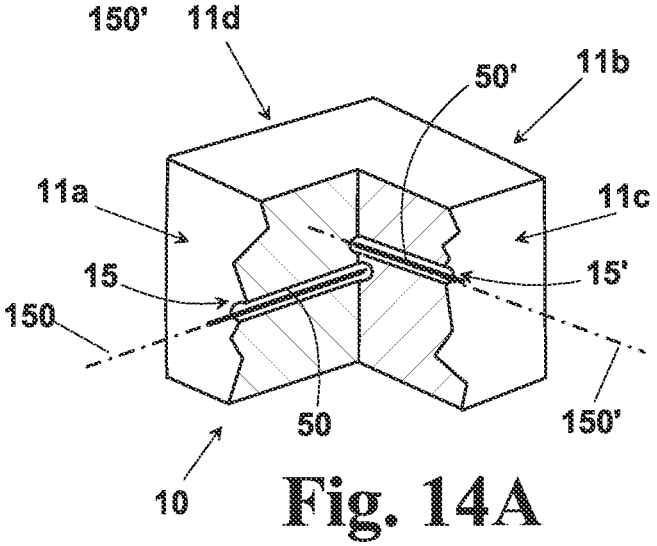
FIGS. 14, 14B, 14C, 14D schematically show a sectioned view in two orthogonal planes of possible variants of the module of FIG. 13.
Figure 14B:
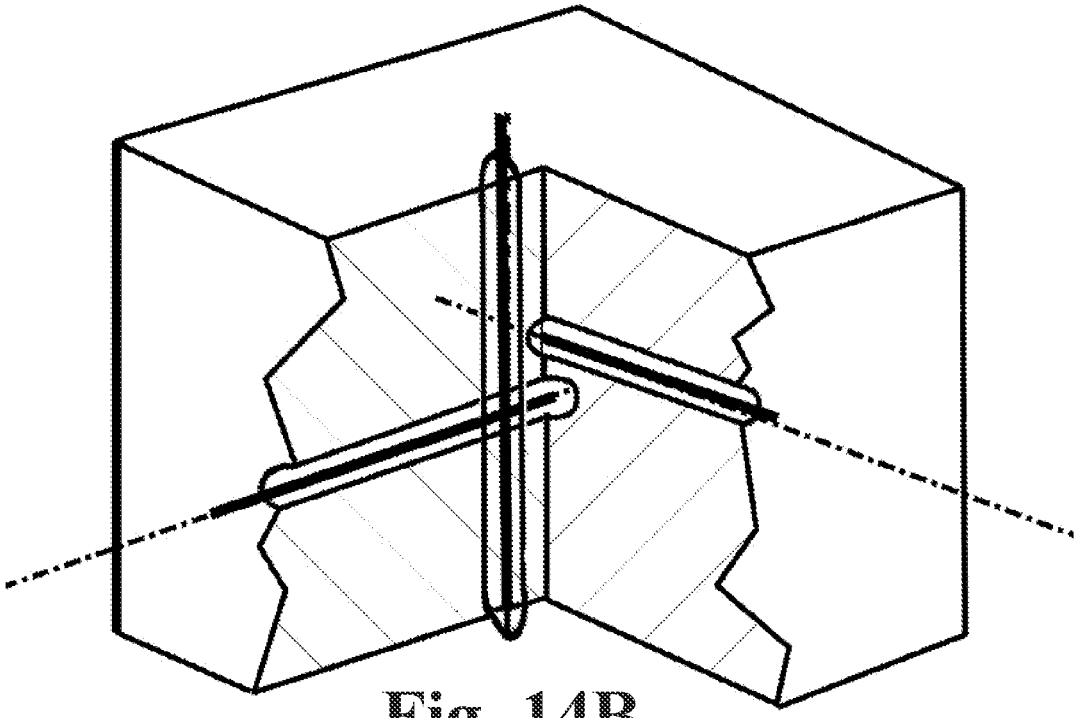
Figure 14C:
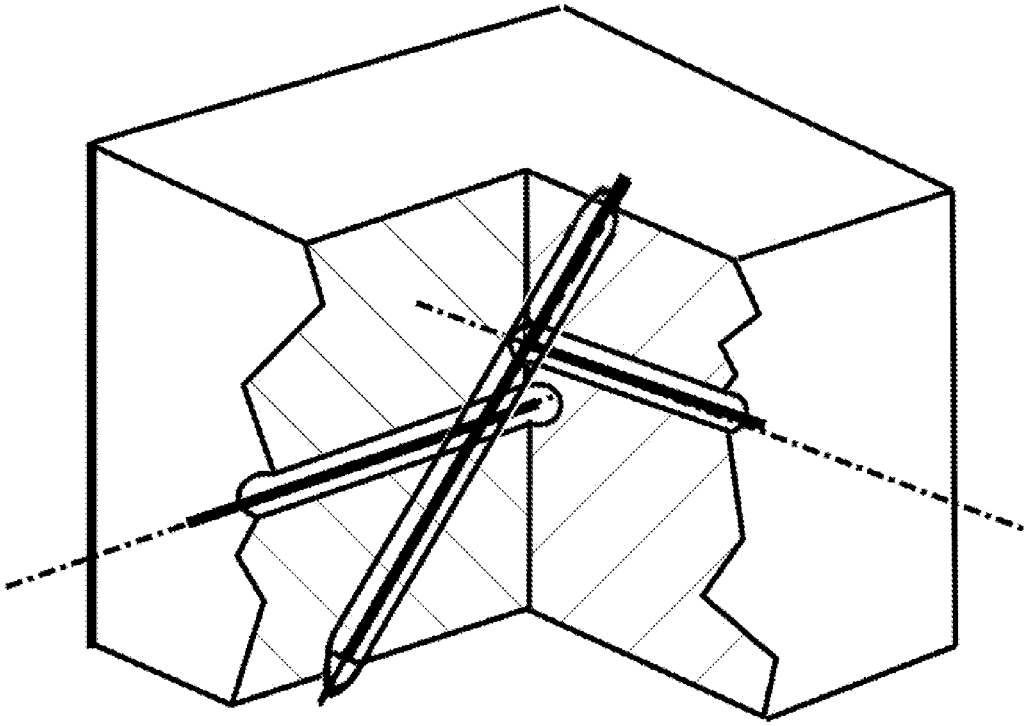
Figure 14D:
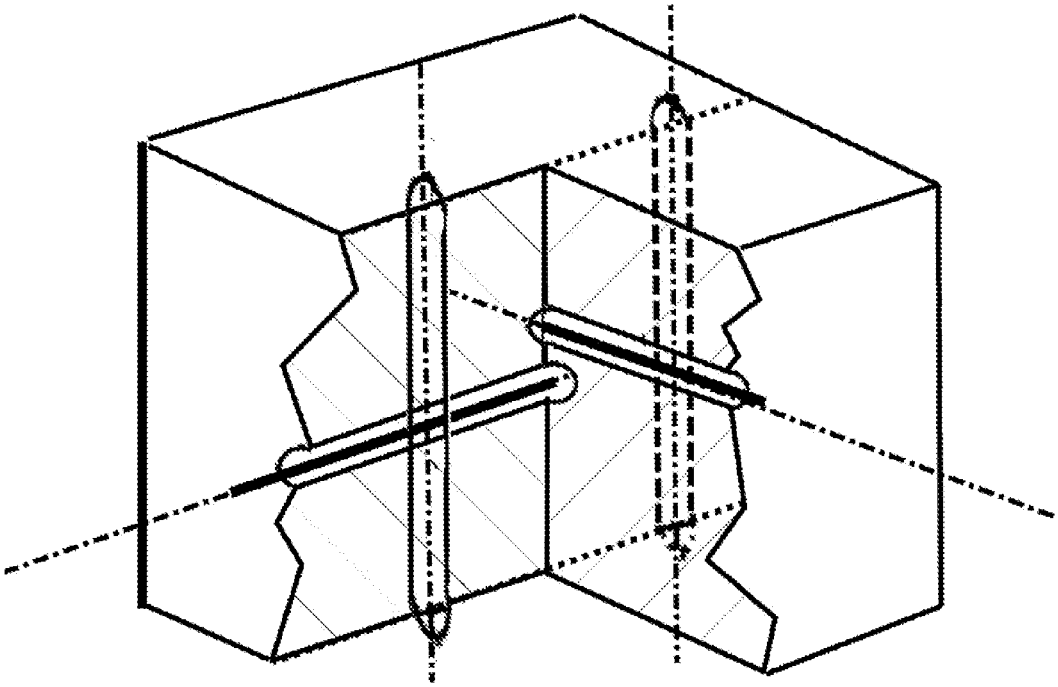
Figure 15A:
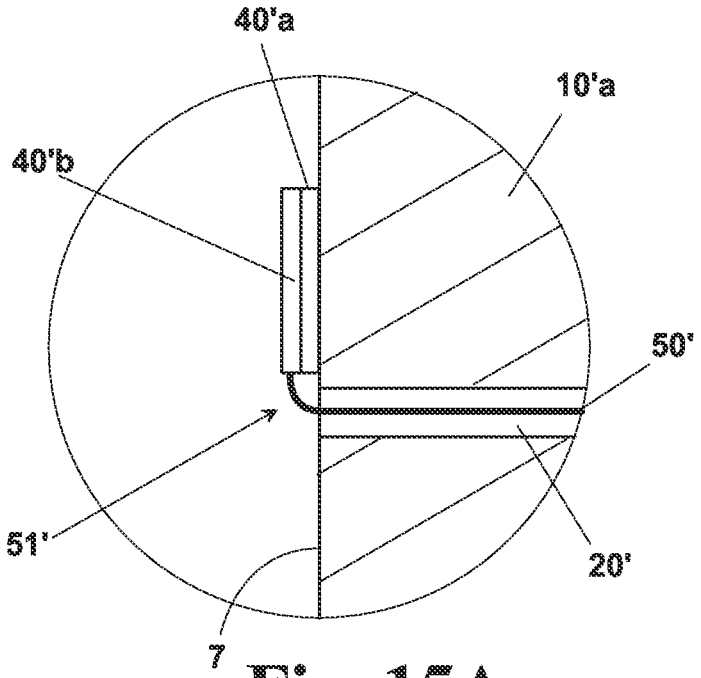
FIGS. 15A and 15B show an enlargement of a respective end module of the modular mattress of FIG. 12 to highlight some technical features.
Figure 15B:
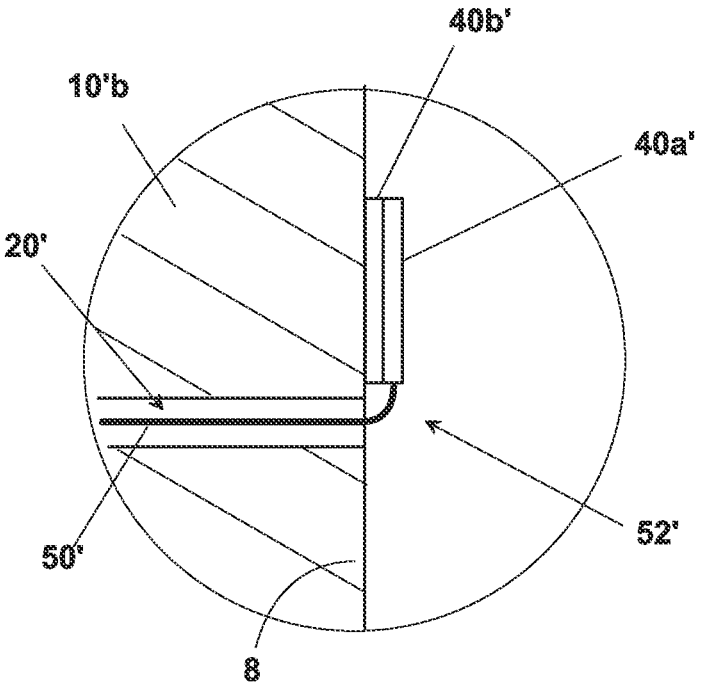
Figure 16:
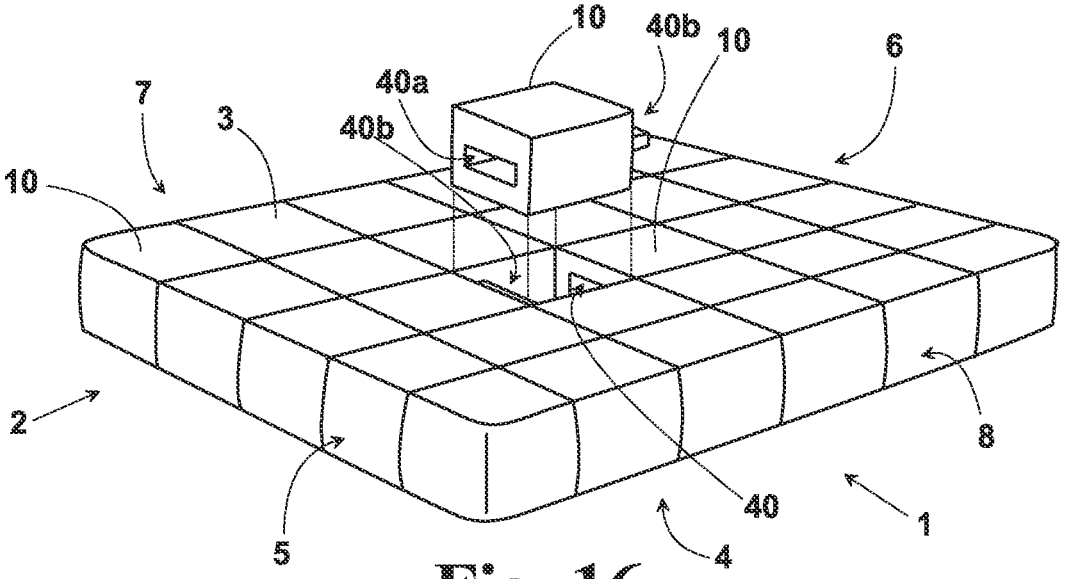
FIG. 16 schematically shows a side elevation perspective view of yet another variant of the modular mattress of FIG. 1.
Figure 17:
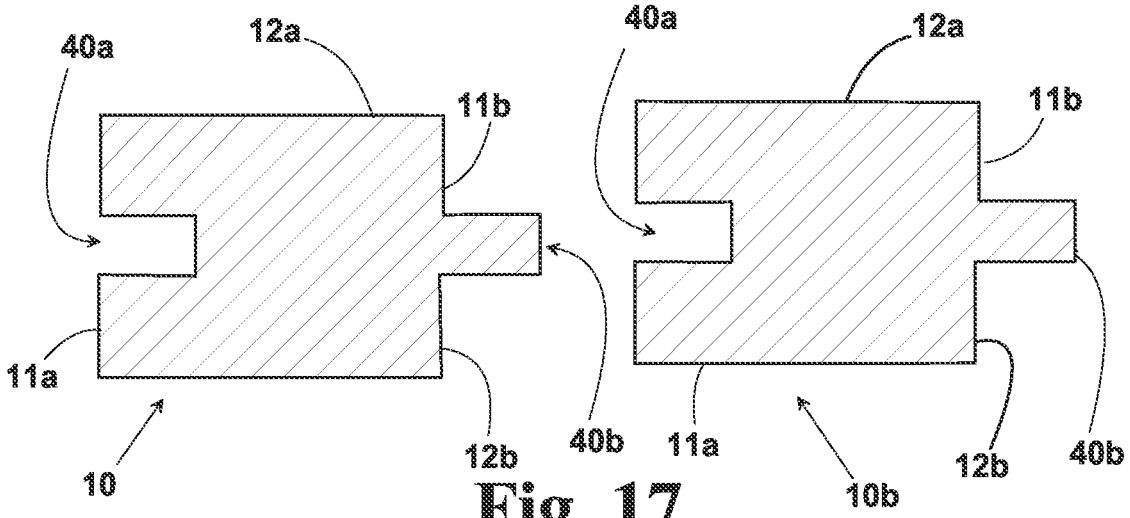
FIG. 17 shows a longitudinal sectional view of two adjacent modules of the mattress of FIG. 16 in a disassembled configuration.
Figure 18:
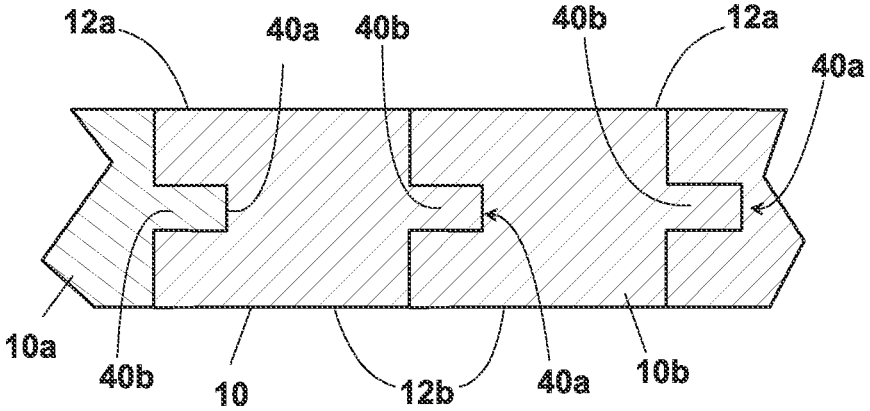
FIG. 18 schematically shows a longitudinal sectional view of some modules of the modular mattress of FIG. 16 in an assembled configuration.
Figure 19:
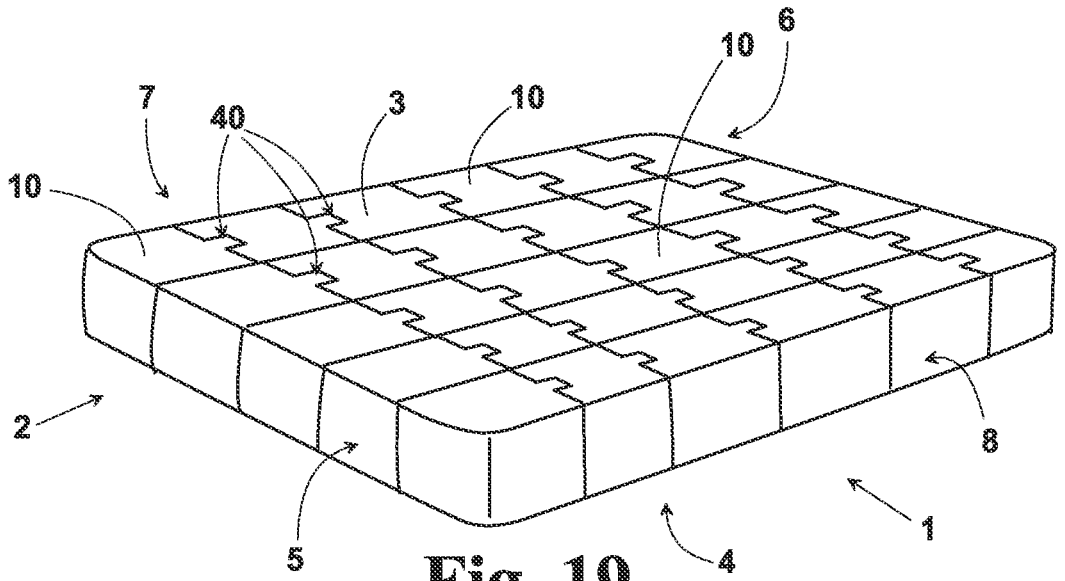
FIG. 19 schematically shows a side elevation perspective view of yet another variant of the modular mattress of FIG. 1.
Figure 20:
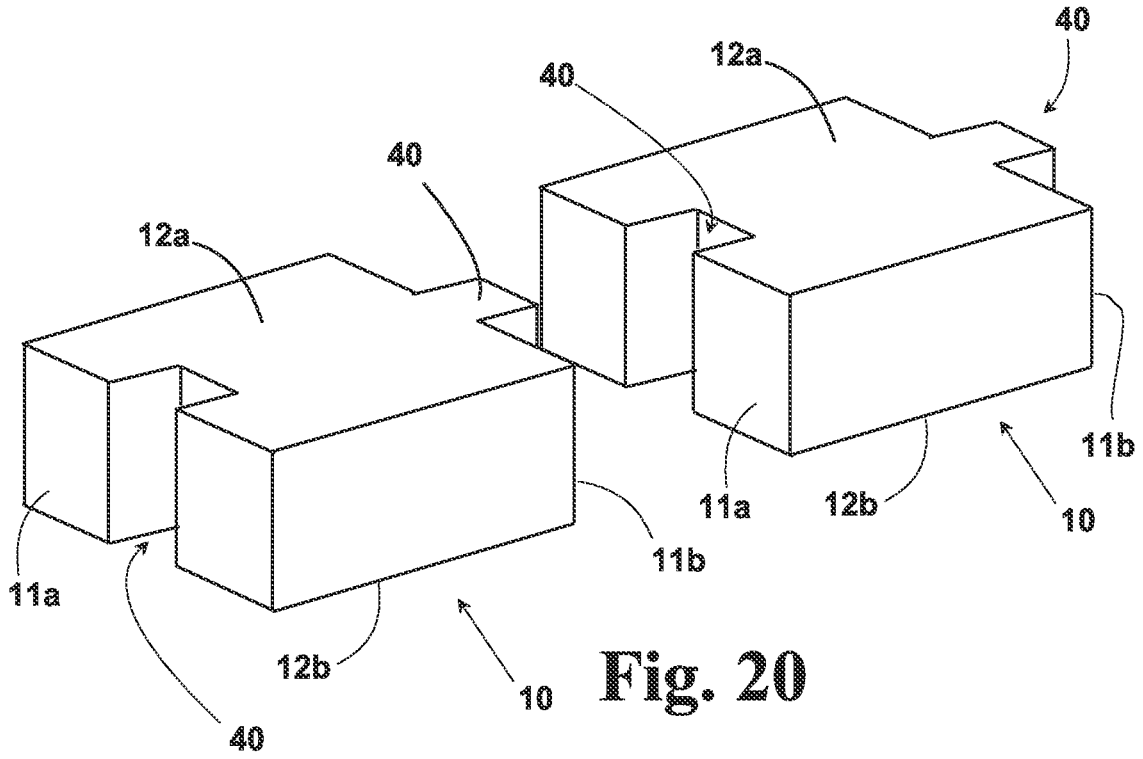
FIG. 20 schematically shows a perspective side elevation view of two modules of the modular mattress of FIG. 19 in a disassembled configuration.

In the further variant schematically illustrated in FIGS. 12 to 15B, in addition to the first group 30 of modules described above with reference to FIGS. 4A to 11, there may be provided at least one additional group 30' of modules 10 provided with respective additional through holes 15' aligned and oriented along a second predetermined direction 150'. In particular, as shown in FIGS. 13 and 14A, the additional through holes 15' may be designed for connecting two opposite surfaces 11*c* and 11*d* of the modules 10 in which they are made.

In particular, the second predetermined direction 150' forms a predetermined angle, for example a 90° angle, with the first predetermined first direction 150. As shown in particular in FIGS. 13, 14A, 14B, 14C, 14D, 15A and 15B, the additional through holes 15' are designed to form an additional passageway 20', and there is at least one additional connection element 50' designed to be arranged in the additional passageway 20'. As shown by way of example in FIG. 13, the hole 15 and additional hole 15' can be made in directions lying in the same plane. In this case, the passageway 20 and the passageway 20' will also be oriented along respective directions belonging to the same plane. As shown in the variants of FIGS. 14, 14B, 14C and 14D, it is, however, also envisaged that the hole 15 and the additional hole 15' may be made in directions lying in different planes, for example advantageously parallel, but also transversal. In this case, the passageway 20 and the passageway 20' will also be oriented along respective directions belonging to different, advantageously parallel planes.

Similarly to what is described above for the, or each, connection element 50, the, or each, additional connection element 50' may be provided, at opposite ends 51', and 52', with respective additional engagement elements 40' configured to reversibly engage with first and second additional end modules 10"*a* and 10"*b* positioned, respectively, at a third side 7 (see FIG. 15A) and a fourth side 8 (see FIG. 15B) of the unique body 2.

Similarly to that described above with reference to the, or each, connection element 50, the additional engagement elements 40' may also be configured to reversibly engage with respective engagement elements 40' provided at the first and second additional end modules 10"*a* and 10"*b*. The additional engagement elements 40' and the respective engagement elements 40' may also be the two engagement parts of a Velcro engagement element, as described in detail above with reference to FIGS. 9A and 9B, or be removable engagement elements of a different type, such as snap buttons, or magnetic elements, or similar engagement elements.

Moreover, as described above in detail for the, or each, connection element 50, the connection elements 50' may also be made of an elastic material, and be positioned in the above-mentioned additional passageway 20' in an elongated configuration in which it is elongated with respect to a rest length and to engage, again in an elongated configuration, its ends 40' at the additional end modules 10"*a* and 10"*b* whereby it is designed to exert an elastic force on the plurality of modules of the additional group 30' connected by it between the first and second additional end modules 10"*a* and 10"*b*.

As schematically illustrated in FIGS. 16 to 20, the engagement elements 40 may comprise a recess 40*a* and a respective protrusion 40*b* made in the adjacent modules 10. More specifically, each recess 40*a* and each protrusion 40*b* of a module 10 may be configured to form a mutual engagement of a reversible type with a respective protrusion 40*b* and a respective recess 40*a* of a respective module 10*a* and 10*b* adjacent to the module 10 at a respective side, for example adjacent to the side 11*a* and the side 11*b*.

According to a possible embodiment, the recesses 40*a* and the protrusions 40*b* may be positioned at an intermediate position between the upper surface 12*a* and the lower surface 12*b* (FIGS. 16-19) or extend from the upper surface 12*a* to the lower surface 12*b* (FIGS. 19 and 20) or, again, according to an embodiment not shown in the drawings for simplicity, extend from the upper surface 12*a*, or from the lower surface 12*b* for a predetermined height less than the height of the module. As shown schematically in FIGS. 16 to 20, the above-mentioned protrusions 40*b* and the above-mentioned recesses 40*a* may be oriented along a substantially horizontal direction (FIGS. 16-18), or along a substantially vertical direction (FIGS. 19 and 20) with respect to the module 10 arranged in the assembled configuration of FIGS. 1, 4, 7, 10-12, 16 and 19.

Advantageously, the protrusions 40*b* can be slightly oversized compared to the recesses 40*a*. More specifically, since the modules 10 may be made of an elastic material, for example a rubber obtained from natural, or synthetic latex, the protrusions 40*b* may be elastically forced to be introduced into the respective recesses 40*a* and then tend to return to their original shape. In this way, the protrusions 40*a* and the recesses 40*b* form a firm anchorage of the respective modules 10 also thanks to the elastic force exerted by the faces of the protrusions 40*b* on the faces of the recesses 40*a*.

In a possible embodiment not shown in the drawings for the sake of simplicity, the above-mentioned protrusions 40*b* and the above-mentioned recesses 40*a* may have a dovetail shape.

In particular, each module 10 of the plurality of modules 10 comprising the modular mattress 1 may have dimensions of between 5×5×5 cm and 40×40×40 cm, advantageously between 10×10×10 cm and 30×30×30 so as to be easily introduced into a washing machine of standard dimensions through the relative entry door.

It should be noted that the different embodiments described above with reference to FIGS. 1 to 20 can be combined together. More specifically, embodiments provided with all or part of the various engagement elements described above may be envisaged.

The technical solution according to the invention and described above with reference to FIGS. 1 to 20 allows, on the one hand, to solve the problem of washing and/or sanitising the mattress, since the various modules 10 into which it is subdivided have, as described above, dimensions such as to be able to be washed in washing machines of the type commonly used in a domestic environment, or sterilised by means of an autoclave, and, on the other hand, ensures, in particular thanks to the presence of the engagement elements 40 and the possible connection elements 50 present, that the unique body 2, once formed by assembling the various modules 10 together, can maintain the desired shape. According to another aspect of the invention, the above-mentioned modules 10 can be stored inside a casing, or bag, of the type commonly known as space-saving casings, or containers, provided with a valve which allows them, by means of a simple vacuum cleaner, to be placed under vacuum in order to reduce their bulk as much as possible with considerable saving in space at the time of their storage.

The above description of certain specific embodiments is able to demonstrate the invention from a conceptual point of view in such a way that others, using the prior art, will be able to modify and/or adapt in various applications such specific embodiments without further research and without departing from the inventive concept, and, therefore, it is understood that such adaptations and modifications will be considered as equivalents of the specific embodiment. The means and the materials to achieve the various functions described may be of various kinds, without thereby departing from the scope of the invention. It is to be understood that the expressions or terminology used are purely descriptive and therefore non-limiting.

The invention claimed is:

1. A modular mattress (1) comprising a plurality of modules (10) configured to be positioned adjacent to each other so as to form a unique body (2) having a support surface (3) for a user, said modular mattress (1) comprising a plurality of engagement elements (40) configured to reversibly engage at least a first and a second module (10) of said plurality of modules (10), in such a way as to avoid movement out of a correct relative position, said modular mattress (1) being characterised in that said plurality of modules (10) comprises at least a group (30) of modules providing respective through holes (15) aligned and oriented along a first predetermined direction (150), said aligned through holes (15) being arranged to form a passageway (20) passing through said modules (10) of said, or each, group (30), and there is, furthermore, provided at least one connection element (50) configured to be positioned within said passageway (20), said, or each, connection element (50) being provided at opposite ends (51, 52), with respective engagement elements (40) configured to reversibly engage with respective engagement elements (40) of a first and a second end module (10'*a*, 10'*b*) positioned, respectively, at opposite sides of said, or each, group (30) of modules (10), wherein:

said plurality of engagement elements (40) comprises first engagement elements (40*a*) and second engagement elements (40*b*) designed to form said engagement of a reversible type and wherein at least said first and second modules (10) of said plurality are positioned adjacent to each other and are, respectively, provided at respective engagement surfaces facing each other with said first and said second engagement elements (40*a*, 40*b*), and said first and said second engagement elements (40*a*, 40*b*, 40'*a*, 40'*b*) comprise respectively a first and a second engagement part of a Velcro element (40, 40').

2. The modular mattress (1) according to claim 1, wherein at least an additional group (30') of modules (10) is provided having respective additional through holes (15') aligned and oriented along a second predetermined direction (150') forming a predetermined angle with said predetermined first direction (150), said additional through holes (15') being designed to form an additional passageway (20'), and being provided with at least an additional connection element (50') designed to be positioned in said additional passageway (20') and provided, at opposite ends (51', 52'), with respective engagement elements (40') configured to reversibly engage with respective engagement elements (40) of a first and a second additional end module (10"a, 10"b) positioned, respectively, at opposite sides of said, or each, additional group (30') of modules (10).

3. The modular mattress (1) according to claim 1, wherein said, or each, connection element (50, 50') is made of an elastic material, said, or each, connection element (50, 50') being designed to be positioned within said passageway (20, 20'), in an elongated configuration, wherein it is elongated with respect to a rest length and wherein, when the engagement elements (40,40') with which it is provided at the opposite ends (51, 52; 51', 52') are designed for being engaged at the respective engagement elements (40, 40') of said first and second end modules (10'*a*, 10'*b*), said, or each, connection element (50, 50') is designed for exerting an elastic force on said, or each, group (30, 30') of modules (10) connected thereto between said first and said second end modules (10'*a*, 10'*b*).

4. The modular mattress (1) according to claim 1, wherein said plurality of modules (10) is selected from:

a plurality of modules (10) all having a same shape but different size;

a plurality of modules (10) all having a same shape and a same size.

5. The modular mattress (1) according to claim 1, wherein said modules (10) of said plurality have a prismatic shape with polygonal cross-section.

6. The modular mattress (1) according to claim 2, wherein said first and said second end modules (10'*a*, 10'*b*) of said, or each, group (30) of modules (10), are respectively positioned at a first side (5) and a second side (6) of said unique body (2), and wherein said first and said second additional end modules (10"*a*, 10"*b*) of said, or each, additional group (30') of modules (10) are respectively positioned at a third side (7) and a fourth side (8) of said unique body (2).

* * * * *